US009846377B2

(12) United States Patent
Asano et al.

(10) Patent No.: US 9,846,377 B2
(45) Date of Patent: Dec. 19, 2017

(54) PHOTOCONDUCTOR, IMAGE FORMING APPARATUS, AND PROCESS CARTRIDGE

(71) Applicants: Tomoharu Asano, Kanagawa (JP); Eiji Kurimoto, Shizuoka (JP); Tetsuro Suzuki, Shizuoka (JP); Daisuke Nii, Shizuoka (JP); Toshihiro Ishida, Shizuoka (JP)

(72) Inventors: Tomoharu Asano, Kanagawa (JP); Eiji Kurimoto, Shizuoka (JP); Tetsuro Suzuki, Shizuoka (JP); Daisuke Nii, Shizuoka (JP); Toshihiro Ishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/331,313

(22) Filed: Oct. 21, 2016

(65) Prior Publication Data

US 2017/0153559 A1 Jun. 1, 2017

(30) Foreign Application Priority Data

Nov. 30, 2015 (JP) ..... 2015-233113

(51) Int. Cl.

| | |
|---|---|
| ***G03G 5/00*** | (2006.01) |
| ***G03G 5/047*** | (2006.01) |
| ***G03G 5/14*** | (2006.01) |

(52) U.S. Cl.

CPC ..... *G03G 5/047* (2013.01); *G03G 5/142* (2013.01)

(58) Field of Classification Search

CPC ..... G03G 5/142

(Continued)

(56) References Cited

U.S. PATENT DOCUMENTS

2006/0078809 A1 4/2006 Nagai et al.
2008/0280221 A1 11/2008 Shimoyama et al.

(Continued)

FOREIGN PATENT DOCUMENTS

JP 2003-098705 4/2003
JP 2006-030700 2/2006

(Continued)

*Primary Examiner* — Mark A Chapman

(74) *Attorney, Agent, or Firm* — Oblon, McClelland, Maier & Neustadt, L.L.P.

(57) ABSTRACT

A photoconductor includes an electroconductive substrate; an undercoat layer overlying the electroconductive substrate; and a photosensitive layer overlying the undercoat layer. The undercoat layer includes a urethane resin, a metal oxide particle and a compound having the following formula (1):

(1)

wherein R1 to R8 independently represent a hydrogen atom, a nitro group, a cyano group, a halogen atom, a hydroxyl group, a saturated or an unsaturated aliphatic hydrocarbon group optionally having a substituent, an aromatic hydrocarbon group optionally having a substituent, an alkoxy group optionally having a substituent, an aryloxy group optionally having a substituent, a sulfo group optionally having a substituent, an amino group, a dialkylamino group optionally having a substituent or an diarylamino group (Continued)

optionally having a substituent; and R3 and R4, R4 and R5, R6 and R7, and R7 and R8 may be bonded with each other to form an aromatic ring.

8 Claims, 3 Drawing Sheets

(58) Field of Classification Search
USPC ..... 430/60, 64
See application file for complete search history.

(56) References Cited

U.S. PATENT DOCUMENTS

| | | | |
|---|---|---|---|
| 2008/0305426 | A1 | 12/2008 | Kurimoto et al. |
| 2010/0233602 | A1 | 9/2010 | Yamamoto et al. |
| 2011/0183255 | A1 | 7/2011 | Kurimoto et al. |
| 2012/0087695 | A1 | 4/2012 | Nagai et al. |
| 2013/0022903 | A1 | 1/2013 | Tanaka et al. |
| 2013/0122409 | A1 | 5/2013 | Koizuka et al. |
| 2013/0243483 | A1 | 9/2013 | Hirose et al. |
| 2013/0244150 | A1 | 9/2013 | Toshine et al. |
| 2013/0251401 | A1 | 9/2013 | Asano et al. |
| 2013/0330104 | A1 | 12/2013 | Shimoyama et al. |
| 2014/0064810 | A1 | 3/2014 | Iwamoto et al. |
| 2014/0178810 | A1 | 6/2014 | Nagai et al. |
| 2014/0199620 | A1 | 7/2014 | Ishida et al. |
| 2014/0234763 | A1 | 8/2014 | Sugino et al. |

FOREIGN PATENT DOCUMENTS

| | | |
|---|---|---|
| JP | 2007-047467 | 2/2007 |
| JP | 2008-096527 | 4/2008 |
| JP | 2014-199400 | 10/2014 |

PHOTOCONDUCTOR, IMAGE FORMING APPARATUS, AND PROCESS CARTRIDGE

CROSS-REFERENCE TO RELATED APPLICATIONS

This patent application is based on and claims priority pursuant to 35 U.S.C. §119 to Japanese Patent Application No. 2015-233113, filed on Nov. 30, 2015, in the Japan Patent Office, the entire disclosure of which is hereby incorporated by reference herein.

BACKGROUND

Technical Field

The present invention relates to a photoconductor, an image forming apparatus including the photoconductor, and a process cartridge including the photoconductor.

Description of the Related Art

In an image forming method using an image forming apparatus, an image is formed by performing, for example, a charging step, an irradiating step, a developing step, and a transfer step. Recently, an organic photoconductor containing an organic material is widely used as a photoconductor of the image forming apparatus because of advantages such as flexibility, thermal stability, and film-forming property.

Recently, there is a need for photoconductors to have greater degrees of durability and stability along with rapid advancement in full-color, high-speed, and high-definition properties of image forming apparatuses. Moreover, improvement in a surface layer such as a protective layer drastically improves the photoconductor in abrasion durability. Meanwhile, there is a need for each layer constituting the photoconductor (e.g., a photosensitive layer, an intermediate layer, and an undercoat layer) to have electric durability, chemical durability, and stability of electric property to fluctuation of usage environment.

An organic material constituting a photoconductor gradually changes in quality through electrostatic load in the typical electrographic process including repetitive charging and charge neutralizing. As a result, the photoconductor is deteriorated in electric property, and cannot retain electric stability when the photoconductor is used for a long term. It is known that deterioration in charging property adversely affects quality in output images, and causes serious problems such as deterioration in image quality, background fog (hereinafter may be referred to as background stain, fog, and black spots), poor uniformity of images during continuous outputs. It is believed that these problems are closely related to the undercoat layer of the photoconductor. Therefore, improvement in the undercoat layer is necessary in order to obtain durability and high stability of the photoconductor.

Generally, an organic photoconductor includes an electroconductive substrate containing, for example, aluminum, an undercoat layer formed on the substrate, and a photosensitive layer formed on the undercoat layer. The undercoat layer is an electroconductive layer mainly containing a binder resin and electroconductive particles such as metal oxide particles. The undercoat layer is usually formed to provide three functions, which are to be improved: "the function of leakage resistance", which is obtained by covering the surface of the substrate with the undercoat layer; "the function of preventing injection of charges" from the substrate to the photosensitive layer; and "the function of transporting charges" to the substrate, where the charges are generated in the photosensitive layer.

SUMMARY

A photoconductor includes an electroconductive substrate; an undercoat layer overlying the electroconductive substrate; and a photosensitive layer overlying the undercoat layer. The undercoat layer includes a urethane resin, a metal oxide particle and a compound having the following formula (1):

(1)

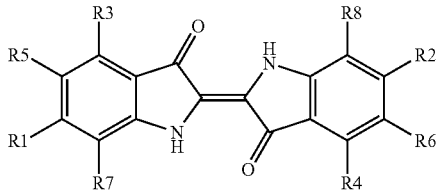

wherein each of R1 to R8 independently represents a hydrogen atom, a nitro group, a cyano group, a halogen atom, a hydroxyl group, a saturated or an unsaturated aliphatic hydrocarbon group which may have a substituent, an aromatic hydrocarbon group which may have a substituent, an alkoxy group which may have a substituent, an aryloxy group which may have a substituent, a sulfo group which may have a substituent, an amino group, a dialkylamino group which may have a substituent or an diarylamino group which may have a substituent; and R3 and R4, R4 and R5, R6 and R7, and R7 and R8 may be bonded with each other to form an aromatic ring.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
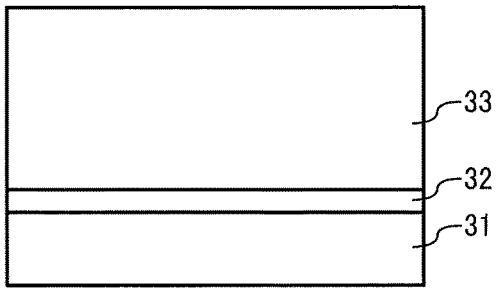
FIG. 1 is a schematic view illustrating an embodiment of layer configuration of the photoconductor of the present invention.

Accordingly, one object of the present invention is to provide a photoconductor having stable electrical properties and suppress background fouling in forming images even after having been used for long periods.

Another object of the present invention is to provide an image forming apparatus using the photoconductor.

A further object of the present invention is to provide a process cartridge including the photoconductor.

(Photoconductor)

A photoconductor of the present embodiment includes an electroconductive substrate, an undercoat layer, and a photosensitive layer, where the undercoat layer is formed over the electroconductive substrate, and the photosensitive layer is formed over the undercoat layer. The photoconductor further includes other layers if necessary.

The photoconductor of the present embodiment includes the undercoat layer containing materials specified in the present disclosure. The typically used products can be used for the electroconductive substrate, the photosensitive layer, and the other layers.

<Undercoat Layer>

Generally, the undercoat layer contains metal oxide particles and a binder resin, and further contains other components if necessary.

The undercoat layer of the photoconductor completely covers an electroconductive substrate with a homogeneous film (function of leak resistance); prevents injection of unnecessary charges (charges having an opposite polarity to charging polarity of the photoconductor) from the electroconductive substrate into the photosensitive layer (charge injection preventability); and transports charges generated in the photosensitive layer, which have the same polarity as charging polarity of the photoconductor (charge transportability). In order to obtain a photoconductor having long-term stability, it is important that the aforementioned functions be not changed through repetitive electrostatic load.

As a result of extensive studies for overcoming these problems, the present inventors found that the aforementioned properties can be obtained by a photoconductor including an electroconductive substrate; an undercoat layer overlying the electroconductive substrate; and a photosensitive layer overlying the undercoat layer, wherein the undercoat layer includes a urethane resin, a metal oxide particle and a compound having the following formula (1):

(1)

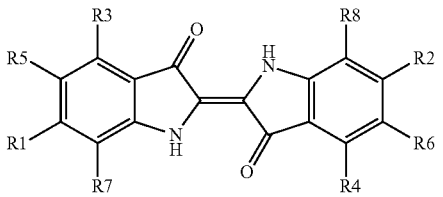

wherein each of R1 to R8 independently represents a hydrogen atom, a nitro group, a cyano group, a halogen atom, a hydroxyl group, a saturated or an unsaturated aliphatic hydrocarbon group which may have a substituent, an aromatic hydrocarbon group which may have a substituent, an alkoxy group which may have a substituent, an aryloxy group which may have a substituent, a sulfo group which may have a substituent, an amino group, a dialkylamino group which may have a substituent or an diarylamino group which may have a substituent; and R3 and R4, R4 and R5, R6 and R7, and R7 and R8 may be bonded with each other to form an aromatic ring.

Although it is not clear why the present embodiment satisfies the functions required for the undercoat layer, the following reasons are conceivable.

The undercoat layer including a urethane resin in which a metal oxide particle and a compound having the formula (1) are uniformly dispersed is thought to have good charge injection preventability and charge transportability, and hold stable electrical properties even when used for long periods.

The undercoat layer including a urethane resin in which a metal oxide particle is dispersed has inner stress. The inner stress concentrates on a microscopic ununiform site of the undercoat layer and the ununiform site the metal oxide particles are densely present has a microscopic crack. The microscopic crack is a local leak point, causing abnormal images such as background fouling. Further, the ununiform site where the metal oxide particles are coarsely present is a charge trap because distances among the particles are long, causing increase of residual potential.

Accordingly, in the present disclosure, the undercoat layer includes a compound having the formula (1). An interaction between the compound having the formula (1) and the urethane resin is thought to buffer the inner stress. Particularly, buffering an inner stress due to concentration of the metal oxide particles on an ununiform site is thought to prevent a microscopic crack of the layer long distances among the particles.

<<Metal Oxide Particle>>

Specific examples of the metal oxide particle include, but are not particularly limited to, titanium oxide particles, zinc oxide particles, tin oxide particles and zirconium oxide particles. Those can achieve the object of the present invention can be selected. These can be used alone or in combination. The zinc oxide particles are preferably used because of having good electrical properties as the metal oxide particles.

However, the metal oxide particles tend to deteriorate due to microscopic abrasions and cracks because of forces when dispersed. As a result, the metal oxide particles are thought to deteriorate in electrical properties, resulting in inability to keep good electrical properties for the undercoat layer to have higher resistivity.

Accordingly, in the present disclosure, the undercoat layer includes a salicylic acid derivative. The salicylic acid derivatives coordinated on the surfaces of the metal oxide particles are thought to prevent the metal oxide particles from deteriorating when dispersed and uniformly disperse them.

Further, an interaction of the salicylic acid derivatives coordinated on the surfaces of the metal oxide particles with the compound having the formula (1) and the urethane resin is thought to reduce cohesion among the metal oxide particles.

As a result, the metal oxide particles are uniformly dispersed in the undercoat layer, and which is thought to keep good electrical properties and anti-leakage.

<<Zinc Oxide Particles>>

The zinc oxide particles are not particularly limited, and zinc oxide particles that can achieve the object of the present invention can be selected. Moreover, two or more zinc oxide particles having different properties can be used in combination.

<<Method of Preparing Zinc Oxide Particles>>

The typically known methods are used to produce the zinc oxide particles of the present disclosure, but a so-called wet method is preferably used among them. The wet method is roughly divided into two methods. One method is as follows: an aqueous solution of a zinc compound (typically, zinc salt) such as zinc sulfate or zinc chloride is neutralized with a solution of soda ash, and the thus-generated zinc carbonate is calcined after washed and dried, to obtain the zinc oxide particles. The other method is as follows: zinc hydroxide particles are formed, and then are calcined after washed and dried to obtain the zinc oxide particles. In the case of zinc oxide particles obtained by the aforementioned wet methods, an amount of a specific element can be intentionally changed depending on choice of materials and the production conditions to easily obtain the zinc oxide particles of the present disclosure.

Details of the wet method will be described below.

Specifically, the wet method includes producing a precipitate from a zinc-containing aqueous solution and an alkaline aqueous solution, aging and washing the precipitate, wetting the precipitate with an alcohol, starting drying the resultant to obtain a zinc oxide particle precursor, and firing the zinc oxide particle precursor to zinc oxide particles. Here, a zinc compound for preparing the zinc-containing aqueous solution is not particularly limited and examples of the zinc compound include zinc nitrate, zinc chloride, zinc acetate, and zinc sulfate. Zinc sulfate is preferable in order for sulfur derived from sulfuric acid to be contained in the zinc oxide used in the present disclosure.

Examples of the alkaline aqueous solution include aqueous solutions of sodium hydroxide, calcium hydroxide, ammonium hydrogen carbonate, and ammonia. A mixture system of sodium hydroxide, ammonium hydrogen carbonate, and calcium hydroxide is particularly preferable as a method as obtaining the zinc oxide used in the present disclosure.

A concentration of sodium hydroxide in the alkaline aqueous solution is preferably an excess concentration that is a multiple by a value in a range of from 1.0 time through 1.5 times of a chemical equivalent needed for the zinc compound to become a hydroxide.

This is because a devoted amount of the zinc compound can react when the alkali is more than or equal to the chemical equivalent and a washing time taken for removing residual alkali is short when the excess concentration is less than or equal to a 1.5-times multiple.

Next, production and aging of a precipitate will be described.

The precipitate is produced by dropping an aqueous solution of the zinc compound into an alkaline aqueous solution continuously stirred. Immediately upon the aqueous solution of the zinc compound being dropped into the alkaline aqueous solution, a degree of supersaturation is reached to produce a precipitate. Therefore, a precipitate of fine particles of zinc carbonate and zinc carbonate hydroxide having a uniform particle diameter can be obtained.

It is difficult to obtain the precipitate of fine particles of zinc carbonate and zinc carbonate hydroxide having a uniform particle size as described above by dropping the alkaline solution into the aqueous solution of the zinc compound or by dropping the solution of the zinc compound and the alkaline solution in parallel. A temperature of the alkaline aqueous solution during production of the precipitate is not particularly limited, but is lower than or equal to 50° C., and is preferably room temperature. A lower limit of the temperature of the alkaline aqueous solution is not specified. However, when a temperature of the alkaline aqueous solution is excessively low, a heating device or the like is necessary. Therefore, a temperature at which no such device needs to be used is preferable.

A dropping time for dripping the aqueous solution of the zinc compound into the alkaline aqueous solution is shorter than 30 min, preferably shorter than or equal to 20 min, and further preferably shorter than or equal to 10 min in terms of productivity. After dropping is completed, stirring is continued for aging in order to homogenize the system internally. An aging temperature is the same as the temperature during production of the precipitate. A time for which stirring is continued is not particularly limited, but is shorter than or equal to 30 min, and preferably shorter than or equal to 15 min in terms of productivity.

The precipitate obtained after the aging is washed by decantation. Adjustment of electroconductivity of a washing solution makes it possible to adjust an amount of sulfate ions remaining in the fine particles. Therefore, a content of sodium, a content of calcium, and a content of sulfate in zinc oxide finally obtained can be controlled.

Next, the washed precipitate is treated by wetting with an alcohol solution and the wetting-treated product is dried to obtain a zinc oxide particle precursor. The wetting treatment can prevent aggregation of the zinc oxide particle precursor obtained after the drying. An alcohol concentration of the alcohol solution is preferably higher than or equal to 50% by mass. The alcohol concentration of higher than or equal to 50% by mass is preferable because the zinc oxide particles can avoid becoming a strong aggregate and have an excellent dispersibility.

The alcohol solution used in the wetting treatment will be described.

An alcohol used in the alcohol solution is not particularly limited but an alcohol soluble in water and having a boiling point of lower than or equal to 100° C. is preferable. Examples of the alcohol include methanol, ethanol, propanol, and tert-butyl alcohol.

The wetting treatment will be described.

The wetting treatment may be performed by putting the filtrated, washed precipitate into the alcohol solution and stirring the precipitate. Here, a time and a stirring speed may be appropriately selected according to the amount treated. The amount of the alcohol solution into which the precipitate is put may be a liquid amount that enables the precipitate to be stirred easily and can secure liquidity. A stirring time and the stirring speed are appropriately selected on the condition that the precipitate that may have been partially aggregated during the filtering and washing described above be uniformly mixed in the alcohol solution until the aggregation is resolved.

The wetting treatment may typically be performed at normal temperature. However, as needed, the wetting treatment may also be performed while performing heating to a degree until which the alcohol does not evaporate and get lost. It is preferable to perform heating at a temperature lower than or equal to the boiling point of the alcohol. This makes it possible to avoid the alcohol dissipating during the wetting treatment and the wetting treatment being ineffective. Persistence of the presence of the alcohol during the wetting treatment is preferable because the effect of the wetting treatment can be obtained and the precipitate does not become a strong aggregate after dried.

The method of drying the wetting-treated product will be described.

Drying conditions such as a drying temperature and a time are not particularly limited and heating drying may be started in the state that the wetting-treated product is wet with the alcohol. The precipitate does not become a strong aggregate even when heating-dried so long as the heating drying is performed after the wetting treatment. Therefore, drying conditions may be appropriately selected depending on the amount of the wetting-treated product treated, a treating apparatus, etc.

Through the drying treatment, a zinc oxide particle precursor that has undergone the wetting treatment can be obtained. The precursor is fired to become zinc oxide particles. The firing of the zinc oxide precursor that has undergone the drying treatment is performed under an atmosphere of an inert gas such as atmospheric air, nitrogen, argon, and helium or an atmosphere of a mixed gas between the inert gas described above and a reducing gas such as hydrogen. Here, a lower limit of a treating temperature is preferably around 400° C. in terms of a desired ultraviolet absorbing (shielding) property. A treating time is appropriately selected depending on the amount of the zinc oxide precursor treated and a firing temperature.

<Average Particle Diameter of Metal Oxide Particles>

A particle diameter (volume average particle diameter) of the metal oxide particles can be appropriately selected depending on the intended purpose, but an average particle diameter is from 20 nm to 200 nm, more preferably from 50 nm to 150 nm. When the average particle diameter is less than 20 nm, it may be difficult to form a film of the undercoat layer having an excellent dispersibility. When it is more than 200 nm, it may be difficult to retain excellent electric property of the undercoat layer.

An average primary particle diameter of the metal oxide particles is determined as follows: 100 particles in the undercoat layer are observed using a transmission electron microscope (TEM); a projected area of each of the particles is determined; each of the projected area diameters of the obtained areas is calculated to determine a volume average particle diameter; and the volume average particle diameter is determined as an average particle diameter.

<<Salicylic Acid Derivative>>

Examples of the salicylic acid derivatives include salicylic acid, acetylsalicylic acid, 5-acetylsalicylic acid, 3-aminosalicylic acid, 5-acetyl salicylamide, 5-aminosalicylic acid, 4-azidesalicylic acid, benzyl salicylate, salicylic acid 4-tert-butylphenyl, butyl salicylate, salicylic acid 2-carboxyphenyl, 3,5-dinitroacetylsalicylic acid, dithio salicylic acid, ethyl acetyl salicylate, 2-ethylhexyl salicylate, ethyl 6-methyl salicylate, ethyl salicylate, 5-formylsalicylic acid, 4-(2-hydroxyethoxy)salicylic acid, salicylic acid 2-hydroxyethyl, isoamyl salicylate, isobutyl salicylate, isopropyl salicylate, 3-methoxysalicylic acid, 4-methoxysalicylic acid, 6-methoxysalicylic acid, methyl acetyl salicylate, methyl 5-acetyl salicylate, methyl 5-allyl-3-methoxy salicylate, methyl 5-formyl salicylate, methyl 4-(2-hydroxyethoxy) salicylate, methyl 3-methoxy salicylate, methyl 4-methoxy salicylate, methyl 5-methoxy salicylate, 4-methyl salicylic acid, 5-methylsalicylic acid, methyl thio salicylate, 3-methyl salicylic acid, 4-methylsalicylic acid, 5-methylsalicylic acid, methyl thio salicylate, salicylic acid 4-nitrophenyl, 5-nitrosalicylic acid, 4-nitrosalicylic acid, 3-nitrosalicylic acid, 4-octylphenyl salicylate, phenyl salicylate, 3-acetoxy-2-naphthanilide, 6-acetoxy-2-naphthoic acid, 3-amino-2-naphthoic acid, 6-amino-2-naphthoic acid, 1, 4-dihydroxy-2-naphthoic acid, 3, 5-dihydroxy-2-naphthoic acid, 3, 7-dihydroxy-2-naphthoic acid, 2-ethoxy-1-naphthoic acid, 2-hydroxy-1-(2-hydroxy-4-sulfo-1-naphthylazo)-3-naphthoic acid, 3-hydroxy-7-methoxy2-naphthoic acid, 1-hydroxy-2-naphthoic acid, 2-hydroxy-1-naphthoic acid, 3-hydroxy-2-naphthoic acid, 6-hydroxy-1-naphthoic acid, 6-hydroxy-2-naphthoic acid, 3-hydroxy-2-naphthoic acid hydrazide, 2-methoxy-1-naphthoic acid, 3-methoxy-2-naphthoic acid, 6-methoxy-2-naphthoic acid, methyl 6-amino-2-naphthoate, methyl 3-hydroxy-2-naphthoate, methyl 6-hydroxy-2-naphthoate, 3-methoxy-2-methyl naphthoate, phenyl 1, 4-dihydroxy-2-naphthoate, and phenyl 1-hydroxy-2-naphthoate, etc. These may be used alone or in combination.

<Content of Salicylic Acid Derivative>

A content of the salicylic acid derivative is preferably in a range of from 0.3% by mass through 6% by mass, more preferably in a range of from 1.5% by mass through 4.0% by mass, still more preferably in a range of from 1% by mass through 3% by mass, relative to the amount of the metal oxide particles before treatment. When 0.3% by mass or more, the undercoat layer can obtain functions derived from the salicylic acid derivative, which results in good properties. Moreover, when 6% by mass or less, dispersion of the zinc oxide particles is not prevented, which results in sufficient properties. These may be used alone or in combination.

<<Urethane Resin>>

The urethane resin is not particularly limited and marketed urethane resins can be used. Examples of the urethane resin include curable resins such as thermoplastic resins and thermosetting resins. These may be used alone or in combination. Among them, considering that the photosensitive layer, which will be described below, is coated on the undercoat layer, a urethane resin high in solvent resistance against common organic solvents is preferable. Examples of the urethane resins high in solvent resistance include curable resins which form three-dimensional network structures.

<<Other Components>>

The undercoat layer may contain other components in order to improve the undercoat layer in electric property, environmental stability, and image quality.

The other components are not particularly limited and may be appropriately selected depending on the intended purpose. Examples of the other components include electron transport materials; electron transport pigments such as polycyclic condensate pigments and azo-pigments; silane coupling agents; zirconium chelate compounds; titanium chelate compounds; aluminum chelate compounds; fluorenone compounds; titanium alkoxide compounds; organotitanium compounds; and the below-described antioxidants, plasticizers, lubricants, ultraviolet absorbing agents, and leveling agents. These may be used alone or in combination.

A method of dispersing the zinc oxide particles in the coating liquid for undercoat layer is not particularly limited and may be appropriately selected depending on the intended purpose. Examples of the method include a method of dispersing the zinc oxide particles using, for example, a ball-mill, a sand-mill, a vibrating-mill, a three-roll mill, an attritor, a pressure homogenizer, or ultrasonic dispersion.

A method of coating the undercoat layer is not particularly limited and may be appropriately selected depending on viscosity of the coating liquid and a film thickness of the undercoat layer to be desired. Examples of the method include a dip coating method, a spray coating method, a bead coating method, and a ring coating method.

The coating liquid for undercoat layer is used for coating, and then the coated film may be heated or dried using an oven if necessary. A temperature of drying the undercoat layer is not particularly limited and may be appropriately selected depending on the kind of a solvent contained in the coating liquid for undercoat layer, but it is preferably from 80° C. to 200° C., more preferably from 100° C. to 150° C.

<<Average Thickness of Undercoat Layer>>

An average thickness of the undercoat layer is not particularly limited and may be appropriately selected depending on electric property and lifetime of the photoconductor to be produced, but it is preferably in a range of from 7 μm through 30 μm, more preferably in a range of from 10 μm through 25 μm.

When the average thickness of the undercoat layer is 7 μm or more, there do not occur image defects such as background fog, which is caused due to poor charging property, and is caused by flow of charges having polarity opposite to charging polarity on the surface of the photoconductor from the electroconductive substrate into photosensitive layer. Meanwhile, the average thickness is 30 μm or less, there do not occur problems such as degradation of an optical attenuating function due to a rise of a residual potential and degradation of repeating stability. As a method of measuring a thickness of the undercoat layer, an eddy-current film thickness meter, a contact thickness meter, a scanning electron microscope, and a transmission electron microscope can be used. The average thickness of the undercoat layer is determined by calculating the average value of thicknesses randomly-selected five points of the undercoat layer.

<Photosensitive Layer>

The photosensitive layer may be a multilayered photosensitive layer or a single-layered photosensitive layer.

<<Single-Layer Photosensitive Layer>>

The single-layered photosensitive layer is a layer having both of charge generatability and charge transportability.

The single-layered photosensitive layer contains a charge generation material, a charge transport material, and a binder resin, and further contains other components if necessary.

—Charge Generation Material—

The charge generation material is not particularly limited and may be appropriately selected depending on the intended purpose. The same substance as used in the laminated photosensitive layer, which will be described hereinafter, can be used for the charge generation material. A content of the charge generation material is not particularly limited and may be appropriately selected depending on the intended purpose, but it is preferably in a range of from 5 parts by mass through 40 parts by mass relative to 100 parts by mass of the binder resin.

—Charge Transport Material—

The charge transport material is not particularly limited and may be appropriately selected depending on the intended purpose. The same substance as used in the multilayered photosensitive layer, which will be described hereinafter, can be used for the charge transport material. A content of the charge transport material is not particularly limited and may be appropriately selected depending on the intended purpose, but it is preferably 190 parts by mass or less, more preferably in a range of from 50 parts by mass through 150 parts by mass relative to 100 parts by mass of the binder resin.

—Binder Resin—

The binder resin is not particularly limited and may be appropriately selected depending on the intended purpose. The same binder resin as used in the multilayered photosensitive layer, which will be described hereinafter, can be used for the binder resin.

—Other Components—

The other components are not particularly limited and may be appropriately selected depending on the intended purpose. Examples of the other components include: the same low-molecular-weight charge transport material as used in the multilayered photosensitive layer and the same solvent as used therein, which will be described hereinafter; an antioxidant; a plasticizer; a lubricant; an UV absorber; and a leveling agent, which will be described hereinafter.

—Method of Forming Single-Layered Photosensitive Layer—

A method of forming the single-layered photosensitive layer is not particularly limited and may be appropriately selected depending on the intended purpose. Examples of the method include a method in which a coating liquid is coated and dried to form the single-layer photosensitive layer, where the coating liquid is obtained by dissolving or dispersing a charge generation material, a charge transport material, a binder resin, and other components in an appropriate solvent (e.g., tetrahydrofuran, dioxane, dichloroethane, and cyclohexane) using a disperser.

A method of coating the coating liquid is not particularly limited and may be appropriately selected depending on the intended purpose. Examples of the method include a dip coating method, a spray coating method, a bead coating method, and a ring coating method. Moreover, a plasticizer, a leveling agent, and an antioxidant may be added to the coating liquid if necessary.

A thickness of the single-layer photosensitive layer is not particularly limited and may be appropriately selected depending on the intended purpose, but it is preferably in a range of from 5 μm through 25 μm.

<<Multilayered Photosensitive Layer>>

The multilayered photosensitive layer includes different layers having charge generatability and charge transportability, and includes a charge generation layer and a charge transport layer. Note that, typically known materials can be used for the charge generation layer and the charge transport layer.

In the laminated photosensitive layer, the order of lamination of the charge generation layer and the charge transport layer is not particularly limited and may be appropriately selected depending on the intended purpose. Most of the charge generation materials are poor in chemical stability, and may be deteriorated in charge generation efficiency when the charge generation materials are subjected to acidic gas that is a product obtained through discharging around a charging device during an electrophotography forming process. Therefore, it is preferable that the charge transport layer be formed on the charge generation layer.

—Charge Generation Layer—

The charge generation layer contains a charge generation material, preferably contains a binder resin, and if necessary further contains other components such as an antioxidant, which will be described hereinafter.

——Charge Generation Material——

The charge generation material is not particularly limited and may be appropriately selected depending on the intended purpose. Examples of the charge generation material include inorganic materials and organic materials.

———Inorganic Material———

The inorganic material is not particularly limited and may be appropriately selected depending on the intended purpose. Examples of the inorganic material include crystal selenium, amorphous selenium, selenium-tellurium, selenium-tellurium-halogen, selenium—an arsenic compound, and amorphous-silicone (for example, a dangling bond of the inorganic material terminated by a hydrogen atom or a halogen atom; and compounds containing a boron atom or a phosphorus atom are preferable).

———Organic Material———

The organic material is not particularly limited and may be appropriately selected depending on the intended purpose. Examples of the organic material include phthalocyanine pigments (e.g., metal phthalocyanine and metal-free phthalocyanine), azulenium salt pigments, methine squarate pigments, azo pigments having a carbazole skeleton, azo pigments having a triphenylamine skeleton, azo pigments having a diphenylamine skeleton, azo pigments having a dibenzothiophene skeleton, azo pigments having fluorenone skeleton, azo pigments having a oxadiazole skeleton, azo pigments having a bisstilbene skeleton, azo pigments having a distyryloxadiazole skeleton, azo pigments having a distyrylcarbazole skeleton, perylene pigments, anthraquinone or polycyclic quinone pigments, quinoneimine pigments, diphenylmethane and triphenylmethane pigments, benzoquinone and naphthoquinone pigments, cyanine and azomethine pigments, indigoid pigments, and bisbenzimidazole pigments. These may be used alone or in combination.

When the azo pigment absorbing light having a wavelength of 655 nm is used in the charge generation layer, an abnormal image (moire) due to an interference fringe tends to be produced, which is caused by writing light (incident light) transmitting to the undercoat layer without being absorbed by the charge generation layer, and scattering at an interface between the charge generation layer, in the undercoat layer and on the surface of the electroconductive substrate. The compound having the formula (1) in the undercoat layer has an effect of preventing the moire. It is thought this is because light absorption ranges of the azo pigment and the compound having the formula (1) are overlapped.

——Binder Resin——

The binder resin is not particularly limited and may be appropriately selected depending on the intended purpose. Examples of the binder resin include polyamide resins, polyurethane resins, epoxy resins, polyketone resins, polycarbonate resins, silicone resins, acrylic resins, polyvinyl butyral resins, polyvinylformal resins, polyvinylketone resins, polystyrene resins, poly-N-vinylcarbazole resins, and polyacrylamide resins. These may be used alone or in combination.

In addition to the aforementioned binder resins, the binder resin may contain a charge transport polymer material having a function of transporting charges. Examples of the binder resin usable include polycarbonates containing an arylamine skeleton, a benzidine skeleton, a hydrazone skeleton, a carbazole skeleton, a stilbene skeleton, and a pyrazoline skeleton; polymer materials such as polyester, polyurethane, polyether, polysiloxane, and acrylic resins; and polymer materials containing a polysilane skeleton.

——Other Components——

The other components are not particularly limited and may be appropriately selected depending on the intended purpose. Examples of the other components include low-molecular-weight charge transport materials, solvents, antioxidants, plasticizers, lubricants, ultraviolet absorbing agents, and leveling agents, where the antioxidants, the plasticizers, the lubricants, the ultraviolet absorbing agents, and the leveling agents will be described hereinafter.

A content of the other components is not particularly limited and may be appropriately selected depending on the intended purpose, but it is preferably in a range of from 0.01% by mass through 10% by mass relative to the total mass of the coating liquid for charge generation layer.

———Low-Molecular-Weight Charge Transport Material———

The low-molecular-weight charge transport material is not particularly limited and may be appropriately selected depending on the intended purpose. Examples of the low-molecular-weight charge transport materials include electron transport materials and hole transport materials.

The electron transport materials are not particularly limited and may be appropriately selected depending on the intended purpose. Examples of the electron transport materials include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2, 4, 8-trinitrothioxanthone, 2, 6, 8-trinitro-4H-indeno[1, 2-b]thiophen-4-one, 1, 3, 7-trinitrodibenzothiophene-5, 5-dioxide, and diphenoquinone derivatives. These may be used alone or in combination.

The hole transport material is not particularly limited and may be appropriately selected depending on the intended purpose. Examples of the hole transport material include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. These may be used alone or in combination.

———Solvent———

The solvent is not particularly limited and may be appropriately selected depending on the intended purpose. Examples of the solvent include tetrahydrofuran, dioxane, dioxolane, toluene, dichloromethane, monochlorobenzene, dichloroethane, cyclohexanone, cyclopentanone, anisole, xylene, methylethylketone, acetone, ethyl acetate, and butyl acetate. These may be used alone or in combination.

——Method of Forming Charge Generation Layer——

A method of forming the charge generation layer is not particularly limited and may be appropriately selected depending on the intended purpose. Examples of the method include a method in which the charge generation material and the binder resin are dissolved or dispersed in other components such as the solvent to obtain a coating liquid; and the coating liquid is coated on the electroconductive substrate, followed by drying, to obtain the charge generation layer. Note that, the coating liquid can be coated by a casting method.

A thickness of the charge generation layer is not particularly limited and may be appropriately selected depending on the intended purpose, but it is preferably in a range of from 0.01 μm through 5 μm, more preferably in a range of from 0.05 μm through 2 μm.

—Charge Transport Layer—

The charge transport layer is a layer that retains charges, and transfers charges generated and separated through irradiation in the charge generation layer to be combined with the retained charges. In order to achieve the object of retaining the charges, the charge transport layer is required to have high electric resistance. In order that the retained charges obtain high surface potential, the charge transport layer is required to have low permittivity and good electric charge mobility. The charge transport layer contains a charge transport material, preferably contains a binder resin, further contains other components if necessary.

——Charge Transport Material——

The charge transport material is not particularly limited and may be appropriately selected depending on the intended purpose. Examples of the charge transport material include electron transport materials, hole transport materials, and polymer charge transport materials.

A content of the charge transport material relative to the total amount of the charge transport layer is not particularly limited and may be appropriately selected depending on the intended purpose, but it is preferably in a range of from 20% by mass through 90% by mass, more preferably in a range of from 30% by mass through 70% by mass. When the amount thereof is less than 20% by mass, electron transport property of the charge transport layer is lowered, and thus desired optical attenuating property may not be obtained. When the amount thereof is more than 90% by mass, various hazards generated from the image forming step may cause excessive abrasion of the photoconductor. Meanwhile, the amount of the charge transport material in the charge transport layer in the more preferable range is advantageous in that desired optical attenuating property may be obtained, and an electrophotographic photoconductor low in abrasion through uses can be obtained.

———Electron Transport Materials———

The electron transport materials (electron accepting substance) are not particularly limited and may be appropriately selected depending on the intended purpose. Examples of the electron transport materials include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2, 4, 8-trinitrothioxanthone, 2, 6, 8-trinitro-4H-indeno[1, 2-b]thiophen-4-one, and 1, 3, 7-trinitrodibenzothiophene-5, 5-dioxide. These may be used alone or in combination.

———Hole Transport Material———

The hole transport material (electron donating substance) is not particularly limited and may be appropriately selected depending on the intended purpose. Examples of the hole transport material include oxazole derivatives, oxadiazole derivatives, imidazole derivatives, triphenylamine derivatives, 9-(p-diethylaminostyrylanthracene), 1, 1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. These may be used alone or in combination.

———Polymer Charge Transport Material———

The polymer charge transport material is a material having both of the function of the charge transport material and the function of the binder resin, which will be described hereinafter.

The polymer charge transport material is not particularly limited and may be appropriately selected depending on the intended purpose. Examples of the polymer charge transport material include polymers containing a carbazole ring, polymers containing a hydrazone structure, polysilylene polymers, polymers containing a triarylamine structure (e.g., polymers containing a triarylamine structure disclosed in Japanese Patents Nos. JP-3852812-B2 and JP-3990499-B2), polymers containing an electron donating group, and other polymers. These may be used alone or in combination. The polymer charge transport material may be used in combination with the binder resin, in terms of abrasion durability and film-forming property.

A content of the polymer charge transport material relative to the total amount of the charge transport layer is not particularly limited and may be appropriately selected depending on the intended purpose. When the polymer charge transport material is used in combination with the binder resin, the amount of the polymer charge transport material and the binder resin is preferably in a range of from 40% by mass through 90% by mass, more preferably in a range of from 50% by mass through 80% by mass.

——Binder Resin——

The binder resin is not particularly limited and may be appropriately selected depending on the intended purpose. Examples of the binder resin include polycarbonate resins, polyester resins, methacryl resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinylcarbazole resins, polyvinyl butyral resins, polyvinylformal resins, polyacrylate resins, polyacrylamide resins, and phenoxy resins. These may be used alone or in combination.

The charge transport layer may contain a copolymer of a cross-linking binder resin and a cross-linking charge transport material.

——Other Components——

The other components are not particularly limited and may be appropriately selected depending on the intended purpose. Examples of the other components include a solvent, an antioxidant, a plasticizer, a lubricant, a UV absorber, and a leveling agent, where the antioxidant, the plasticizer, the lubricant, the UV absorber, and the leveling agent will be described hereinafter.

A content of the other components is not particularly limited and may be appropriately selected depending on the intended purpose, but it is preferably in a range of from 0.01% by mass through 10% by mass relative to the total mass of the coating liquid for charge transport layer.

———Solvent———

The solvent is not particularly limited and may be appropriately selected depending on the intended purpose. The solvent can be the same solvent as used in the preparation of the charge generation layer. However, a solvent that can favorably solve the charge generation layer and the binder resin is preferable. These may be used alone or in combination.

——Method of Forming Charge Transport Layer——

A method of forming the charge transport layer is not particularly limited and may be appropriately selected depending on the intended purpose. Examples the method include a method in which a coating liquid is coated on a charge generation layer, which is heated and dried to form a charge transport layer, where the coating liquid is obtained by dissolving or dispersing the charge transport material and the binder resin in the other components (e.g., a solvent).

A method of coating the coating liquid used during formation of the charge transport layer is not particularly limited and may be appropriately selected depending on properties such as viscosity of the coating liquid and a thickness of the charge transport layer desired. Examples of the method include a dip coating method, a spray coating method, a bead coating method, and a ring coating method.

The charge transport layer needs to be heated by any unit to remove the solvent from the charge transport layer in terms of electrophotographic property and viscosity of the film.

Examples of the method of heating the charge transport layer include a method in which air, gas (e.g., nitrogen), vapor, or heat energy (e.g., various heating media, infrared rays, and electromagnetic rays) is used to heat the charge transport layer from a side of the coated surface or a side of the electroconductive substrate.

A temperature at which the charge transport layer is heated is not particularly limited and may be appropriately selected depending on the intended purpose, but it is preferably in a range of from 100° C. through 170° C. When the temperature is less than 100° C., the organic solvent in the film cannot be sufficiently removed, which results in deterioration in electrophotographic property and abrasion durability. Meanwhile, when the temperature is more than 170° C., dents or clacks are generated on the surface and peeling occurs at the interface of the adjacent layer. In addition, desired electric property cannot be obtained when volatile components in the photosensitive layer are dispersed outside.

A thickness of the charge transport layer is not particularly limited and may be appropriately selected depending on the intended purpose, but it is preferably 50 μm or less, more preferably 45 μm or less in terms of resolution and responsiveness. A lower limit of the thickness varies depending on a system to be used (particularly, charge electric potential and the like), but it is preferably 5 μm or more.

<Other Layers>

The other layers are not particularly limited and may be appropriately selected depending on the intended purpose. Examples of the other layers include a protective layer, an intermediate layer, and a second undercoat layer.

<<Protective Layer>>

The protective layer (hereinafter may be referred to as surface layer) can be formed on the photosensitive layer in order to improve the photoconductor in durability and other functions. The protective layer contains a binder resin and fillers, and further contains other components if necessary.

—Binder Resin—

The binder resin is not particularly limited and may be appropriately selected depending on the intended purpose. Examples of the binder resin include AS resins, ABS resins, ACS resins, olefin-vinyl monomer copolymers, chlorinated polyether resins, allyl resins, phenol resins, polyacetal resins, polyamide resins, polyamide imide resins, polyacrylate resins, polyarylsulfone resins, polybutylene resins, polybutylene terephthalate resins, polycarbonate resins, polyethersulfone resins, polyethylene resins, polyethyleneterephthalate resins, polyimide resins, acrylic resins, polymethylpentene resins, polypropylene resins, polyphenylene oxide resins, polysulfone resins, polyurethane resins, polyvinyl chloride resins, polyvinylidene chloride resins, and epoxy resins. These may be used alone or in combination. Among them, polycarbonate resins and polyacrylate resins are preferable in terms of dispersibility of the fillers, and reduction in residual potential and film defect.

—Fillers—

The fillers are not particularly limited and may be appropriately selected depending on the intended purpose. Examples of the fillers include metal oxide fine particles.

The metal oxide fine particles are not particularly limited and may be appropriately selected depending on the intended purpose. Examples of the metal oxide fine particles include aluminum oxide, zinc oxide, titanium oxide, tin oxide, antimony oxide, indium oxide, bismuth oxide, tin-containing indium oxide, tin oxide containing antimony or tantalum, and antimony-containing zirconium oxide. These may be used alone or in combination.

A method of forming the protective layer is not particularly limited and the protective layer can be formed using an appropriate solvent and a coating method as described in the formation of the photosensitive layer. Examples of the method include a dip coating method, a spray coating method, a bead coating method, a nozzle coating method, a spinner coating method, and a ring coating method. A solvent used in the method of forming the protective layer is not particularly limited and may be appropriately selected depending on the intended purpose. Examples of the solvent include tetrahydrofuran, dioxane, toluene, dichloromethane, monochlorobenzene, dichloroethane, cyclohexanone, methylethylketone, and acetone.

The solvent is preferably high in viscosity during dispersion of the binder resin and the fillers, and that solvent be high in volatility during the coating. When there is no solvent satisfying the aforementioned properties, two or more solvents having the aforementioned properties can be mixed for use, which may result in a large effect on residual potential and dispersibility of the fillers.

It is effective and useful that the charge transport material as described for the charge transport layer is added to the protective layer in terms of reduction in residual potential and improvement in image quality.

A thickness of the protective layer is not particularly limited and may be appropriately selected depending on the intended purpose, but it is preferably in a range of from 1 μm through 5 μm in terms of abrasion resistance.

<<Intermediate Layer>>

The intermediate layer can be formed between the charge transport layer and the surface layer in order to prevent the surface layer from contamination of the components of the charge transport layer, or in order to improve adhesiveness between the charge transport layer and the surface layer. The intermediate layer contains a binder resin, and further contains other components such as an antioxidant, which will be described hereinafter, if necessary. The intermediate layer is preferably insoluble or poorly soluble in the coating liquid for surface layer.

The binder resin contained in the intermediate layer is not particularly limited and may be appropriately selected depending on the intended purpose. Examples of the binder resin include polyamide, alcohol-soluble nylon, polyvinyl butyral, and polyvinyl alcohol.

A method of forming the intermediate layer is not particularly limited and may be appropriately selected depending on the intended purpose. The intermediate layer can be formed using the appropriate solvent and the coating method as described in the formation of the photosensitive layer.

A thickness of the intermediate layer is not particularly limited and may be appropriately selected depending on the intended purpose, but it is preferably in a range of from 0.05 μm through 2 μm.

<<Second Undercoat Layer>>

In the photoconductor, the second undercoat layer can be formed between the electroconductive substrate and the undercoat layer, or between the undercoat layer and the photosensitive layer. The second undercoat layer contains a binder resin, further contains other components if necessary.

The binder resin is not particularly limited and may be appropriately selected depending on the intended purpose. Examples of the binder resin include polyamide, an alcohol-soluble nylon, a water-soluble polyvinyl butyral, polyvinyl butyral, and polyvinyl alcohol.

A method of forming the second undercoat layer is not particularly limited and may be appropriately selected depending on the intended purpose. The second undercoat layer can be formed using an appropriate solvent and an appropriate coating method.

A thickness of the second undercoat layer is not particularly limited and may be appropriately selected depending on the intended purpose, but it is preferably in a range of from 0.05 μm through 2 μm.

In order to improve the photoconductor of the present embodiment in resistance to environment, particularly to prevent the photoconductor of the present embodiment from reduction in sensitivity and raising residual potential, an antioxidant, a plasticizer, a lubricant, a UV absorber, and a leveling agent can be added as the other components to each of the layers (e.g., the charge generation layer, the charge transport layer, the undercoat layer, the protective layer, and the second undercoat layer).

The antioxidant is not particularly limited and may be appropriately selected depending on the intended purpose. Examples of the antioxidant include phenol compounds, paraphenylenediamines, hydroquinones, organic sulfur compounds, and organic phosphorus compounds. These may be used alone or in combination.

The plasticizer is not particularly limited and may be appropriately selected depending on the intended purpose. Examples of the plasticizer include plasticizers of the general resins such as dibutyl phthalate and dioctyl phthalate.

The lubricant is not particularly limited and may be appropriately selected depending on the intended purpose. Examples of the lubricant include hydrocarbon compounds, fatty acid compounds, fatty acid amide compounds, ester compounds, alcohol compounds, metal soaps, natural waxes, and other lubricants. These may be used alone or in combination.

The UV absorber is not particularly limited and may be appropriately selected depending on the intended purpose. Examples of the ultraviolet absorbing agent include benzophenone ultraviolet absorbing agents, salicylate ultraviolet absorbing agents, benzotriazole ultraviolet absorbing agents, cyanoacrylate ultraviolet absorbing agents, quenchers (metal complex salt ultraviolet absorbing agents), and HALS (hindered amines stabilizer). These may be used alone or in combination.

The leveling agent is not particularly limited and may be appropriately selected depending on the intended purpose. Examples of the leveling agent include silicone oils such as dimethyl silicone oils and methylphenyl silicone oils; and polymers or oligomers containing a perfluoroalkyl group at a side chain. These may be used alone or in combination.

<Electroconductive Substrate>

The electroconductive substrate is not particularly limited and may be appropriately selected depending on the intended purpose, so long as volume resistivity of the electroconductive substrate is $1\times10^{10}$ Ω·cm or less. Note that, the endless belts (e.g., endless nickel belt, and endless stainless belt) disclosed in Japanese Examined Patent Publication No. JP-S52-36016-B may be used.

A method of forming the electroconductive substrate is not particularly limited and may be appropriately selected depending on the intended purpose. The electroconductive substrate is formed, by for example, coating a support (e.g., a film-like or cylindrical plastic or paper) with a metal (e.g., aluminum, nickel, chromium, nichrome, copper, gold, silver, and platinum) or a metal oxide (e.g., tin oxide and indium oxide) through sputtering or vapor deposition. Moreover, a plate of metal (e.g., aluminum, alloy of aluminum, nickel, and stainless) can be extruded or drawn out, followed by surface treatment (e.g., after forming an original tube, cutting, super-finishing, and polishing) to form the electroconductive substrate.

The electroconductive powder is not particularly limited and may be appropriately selected depending on the intended purpose. Examples of the electroconductive powder include: carbon fine particles (e.g., carbon black and acetylene black); metal powder (e.g., aluminum, nickel, iron, nichrome, copper, zinc, and silver); and metal oxide powder (e.g., electroconductive tin oxide and ITO).

The binder resin used in the electroconductive layer is not particularly limited and may be appropriately selected depending on the intended purpose. Examples of the binder resin include thermoplastic resins, thermosetting resins, and photocurable resins. Specific examples of the binder resin include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethylcellulose resins, polyvinyl butyral resins, polyvinylformal resins, polyvinyltoluene resins, poly-N-vinylcarbazole, acrylic resins, silicone resins, epoxy resins, melamine resins, urethane resins, phenol resins, and alkyd resins.

A solvent used in the electroconductive layer is not particularly limited and may be appropriately selected depending on the intended purpose. Examples of the solvent include tetrahydrofuran, dichloromethane, methylethylketone, and toluene.

Embodiments of Photoconductor

Embodiments of the photoconductor of the present embodiment will be described hereinafter.

First Embodiment

A layer configuration of the photoconductor according to a first embodiment will be described with reference to FIG. 1.

FIG. 1 is a structure containing a single-layer photosensitive layer, and is a view illustrating a layer configuration of the photoconductor where an undercoat layer 32 is formed on an electroconductive substrate 31, and a single-layer photosensitive layer 33 is formed on the undercoat layer 32.

Second Embodiment

A layer configuration of the photoconductor according to a second embodiment will be described with reference to FIG. 2.

Figure 2:
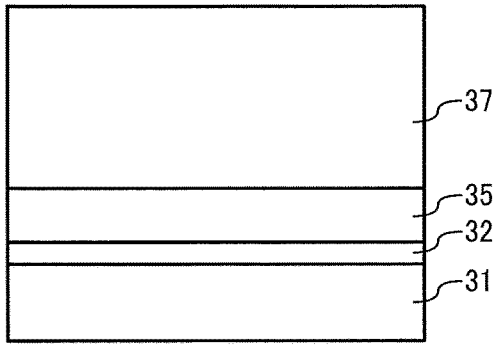
FIG. 2 is a schematic view illustrating another embodiment of layer configuration of the photoconductor of the present invention.

FIG. 2 is a structure containing a multilayered photosensitive layer, and is a view illustrating a layer configuration of the photoconductor where an undercoat layer 32 is formed on an electroconductive substrate 31, a charge generation layer 35 is formed on the undercoat layer 32, and a charge transport layer 37 is formed on the charge generation layer 35. Here, the charge generation layer 35 and the charge transport layer 37 correspond to the photosensitive layer.

Third Embodiment

A layer configuration of the photoconductor according to a third embodiment will be described with reference to FIG. 3.

Figure 3:
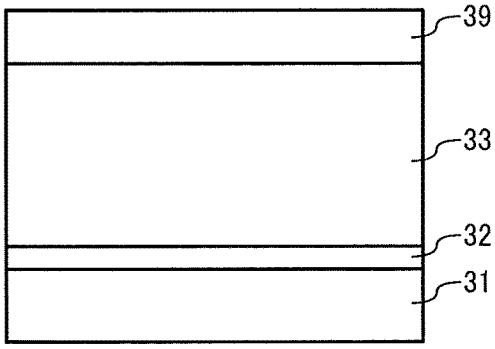
FIG. 3 is a schematic view illustrating a further embodiment of layer configuration of the photoconductor of the present invention.

FIG. 3 is a structure containing a single-layer photosensitive layer, and is a view illustrating a layer configuration of the photoconductor where an undercoat layer 32 is formed on the electroconductive substrate 31, the photosensitive layer 33 is formed on the undercoat layer 32, and a protective layer 39 is formed on the photosensitive layer 33.

Fourth Embodiment

A layer configuration of the photoconductor according to a fourth embodiment will be described with reference to FIG. 4.

Figure 4:
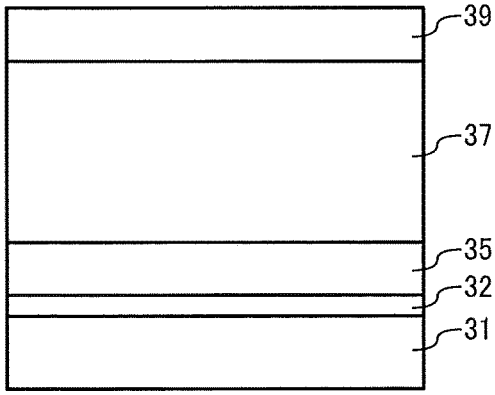
FIG. 4 is a schematic view illustrating another embodiment of layer configuration of the photoconductor of the present invention.

FIG. 4 is a structure containing a multilayered photosensitive layer, and is a view illustrating a layer configuration of the photoconductor where an undercoat layer 32 is formed on an electroconductive substrate 31, a charge generation layer 35 is formed on the undercoat layer 32, the charge transport layer 37 is formed on the charge generation layer 35, and a protective layer 39 is formed on the charge transport layer 37. Note that, the charge generation layer 35 and the charge transport layer 37 correspond to the photosensitive layer.

(Image Forming Apparatus)

An image forming apparatus of the present embodiment includes a photoconductor, a charger to charge the surface of the photoconductor; an irradiator to irradiate the surface of the photoconductor to form an electrostatic latent image, an image developer to develop the electrostatic latent image with a toner to form a visible image; and a transferer to transfer the visible image onto a recording medium, and further includes other units if necessary. The aforementioned photoconductor of the present embodiment is used as the photoconductor in the image forming apparatus. Here, the charger and the irradiator may be collectively referred to as an electrostatic latent image former.

Embodiment of Image Forming Apparatus

Hereinafter, one embodiment of the image forming apparatus of the present embodiment will be described with reference to the following example.

Figure 5:
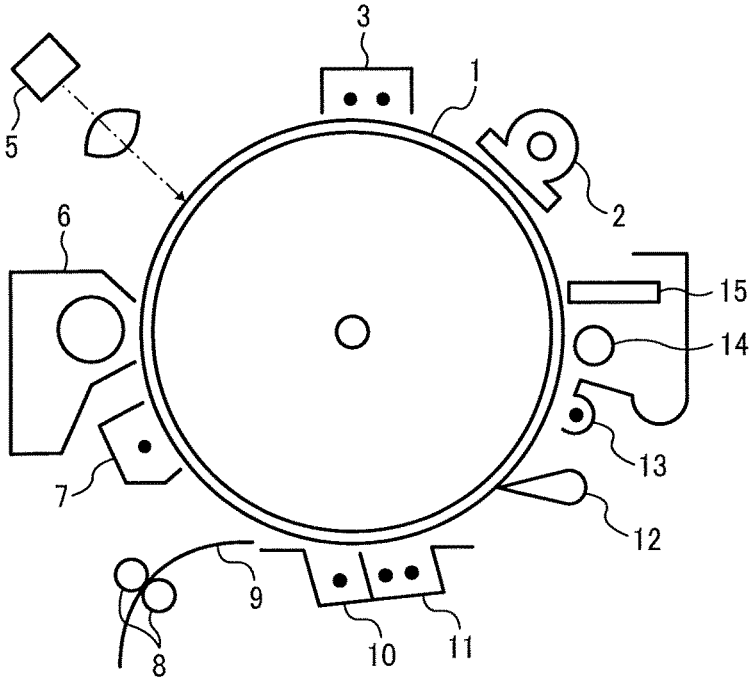
FIG. 5 is a schematic view illustrating an embodiment of the image forming apparatus of the present invention.

FIG. 5 is a schematic view illustrating an embodiment of the image forming apparatus of the present invention. A charger 3, an irradiator 5, an image developer 6, and a transferer 10 are formed around a photoconductor 1. First, the charger 3 uniformly charges the photoconductor 1. As the charger 3, for example, a corotron device, a scorotron device, a solid-state discharging element, a multi-stylus electrode, a roller charging device, and an electroconductive brush device are used, and typically known systems can be used.

Next, an electrostatic latent image is formed on the uniformly charged photoconductor 1 by the irradiator 5. Examples of a light source used in the irradiator include general luminescent products such as a fluorescent lamp, a tungsten lamp, a halogen lamp, a mercury lamp, a sodium-vapor lamp, a light-emitting diode (LED), a laser diode (LD), and electroluminescence (EL). In order to emit light having a predetermined wavelength, various filters such as a sharp cut filter, a band pass filter, a near infrared cut filter, a dichroic filter, an interference filter, and a color conversion filter can be used.

Then, the electrostatic latent image formed on the photoconductor 1 is visualized by the image developer 6. Examples of a developing system used include a one-component development method using a dry toner, a two-component development method, and a wet developing method using a wet toner. The photoconductor 1 is subjected to positive (negative) charging, and then is imagewise exposed to light to form a positively (negatively)-charged electrostatic latent image on the surface of the photoconductor. This electrostatic latent image is developed with a toner (voltage-detecting particles) having negative (positive) polarity to obtain a positive image. Moreover, the latent image is developed with a toner having positive (negative) polarity to obtain a negative image.

Next, the toner image visualized on the photoconductor 1 is transferred onto a recording medium 9 by the transferer 10. Moreover, in order for the toner image to be favorably transferred, a pre-transfer charger 7 may be used. As the transferer 10, an electrostatic transfer system using a transfer charger or a bias roller; a mechanical transfer system (e.g., an adhesive transfer method and a pressure transfer method); and a magnetic transfer system can be used.

A separation charger 11 and a separation claw 12 may be used as a unit to separate the recording medium 9 from the photoconductor 1 if necessary. As other separating units, electrostatic attraction induced separation, side-edge belt separation, tip-grip conveyance, and self stripping are used. As the separation charger 11, a charger can be used. In order to clean the toner remaining on the photoconductor after the image is transferred, a cleaner such as a fur brush 14 and a cleaning blade 15 is used. A pre-cleaning charger 13 may be used in order to effectively perform the cleaning. Examples of other cleaners include a web method and a magnetic brush method. These may be used alone or two or more systems may be used together. A charge neutralizer 2 may be used for removing a latent image on the photoconductor 1. Examples of the charge neutralizer 2 include a charge neutralizing lamp and a charge neutralizer. The irradiation light source and the charger can be used. As the typically known processes, other processes (e.g. scanning manuscripts, feeding sheets of paper, fixing, and paper ejection, where each of the processes is not adjacent to the photoconductor) can be used.

(Process Cartridge)

A process cartridge of the present embodiment includes a photoconductor; and at least one unit selected from the group consisting of a charger to charge the surface of the photoconductor, an irradiator to irradiate the surface of the photoconductor to form an electrostatic latent image, an image developer to develop the electrostatic latent image with a toner to form a visible image, and a transferer to transfer the visible image onto a recording medium, and further includes other units if necessary.

The photoconductor used in the process cartridge of the present embodiment is the photoconductor of the present embodiment as described above.

Figure 6:
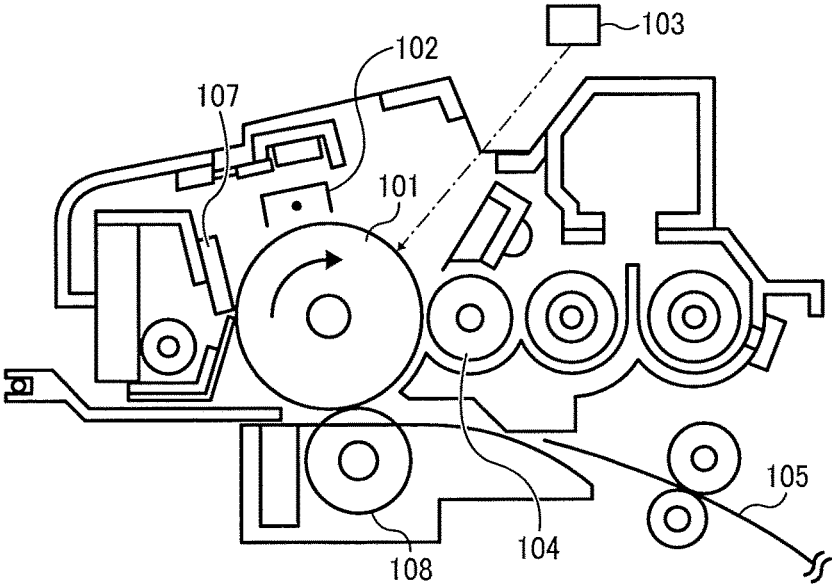
FIG. 6 is a schematic view illustrating an embodiment of the process cartridge of the present invention.

As described in FIG. 6, the process cartridge includes a photoconductor 101 and at least one selected from the group consisting of a charger 102, an image developer 104, a transferer 106, a cleaner 107, and a charge neutralizer. The process cartridge is a device (component) that is detachably mounted on a main body of the image forming apparatus. FIG. 6 illustrates an image forming step by a process cartridge. The photoconductor 101 is subjected to charging by the charger 102 and is irradiated by the irradiator 103 while rotated in the direction indicated by the arrow. Then, the electrostatic latent image, which corresponds to an exposure image, is formed on the surface of the photoconductor 101. This electrostatic latent image is developed with the toner by the image developer 104 to form a developed image. The developed image is transferred onto a recording medium 105 by the transferer 106 to be printed out. Then, after the image is transferred, the surface of the photoconductor is cleaned by the cleaner 107, and is further charge-neutralized by the charge neutralizer. The above procedures are repeated.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts or %, unless otherwise specified.

[Preparation of Coating Liquid for Undercoat Layer A]

Preparation Example 1

<Preparation of Coating Liquid for Undercoat Layer A-1>

The following materials were mixed and stirred using zirconia beads having a diameter of 0.5 mm and a vibration mill at 1,500 rpm for 24 hours to prepare a coating liquid for undercoat layer A-1.

| | |
|---|---|
| Metal oxide particles (zinc oxide particles having an average primary particle diameter of 50 nm prepared by the wet method) | 100 |
| Binder resin: | |
| Blocked isocyanate [SUMIDUR BL-3175 (solid concentration: 75%) from Sumitomo Bayer Urethane Co., Ltd.] | 13 |
| 20% by mass solution obtained by dissolving a butyral resin in 2-butanone (butyral resin: BM-1 from Sekisui Chemical Co., Ltd.) | 50 |
| A compound having the following formula (I) | 0.1 |
| Salicylic acid derivative [3,5-di-t-butylsalicylic acid (TCI-D1947 from Tokyo Chemical Industry Co., Ltd.)] | 1.5 |
| Solvent (2-butanone) | 120 |

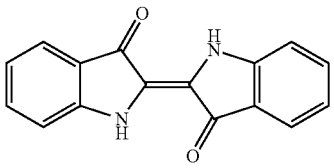

(I)

<Preparation of Coating Liquid for Undercoat Layer A-2>

The procedure for preparation of the coating liquid for undercoat layer A-1 was repeated except for replacing the salicylic acid derivative with 3-aminosalicylic acid (TCI-A0421 from Tokyo Chemical Industry Co., Ltd. to prepare a coating liquid for undercoat layer A-2.

<Preparation of Coating Liquid for Undercoat Layer A-3>

The procedure for preparation of the coating liquid for undercoat layer A-1 was repeated except for replacing the salicylic acid derivative with 3,5-dinitrosalicylic acid (TCI-D0850 from Tokyo Chemical Industry Co., Ltd. to prepare a coating liquid for undercoat layer A-3.

<Preparation of Coating Liquid for Undercoat Layer A-4>

The procedure for preparation of the coating liquid for undercoat layer A-1 was repeated except for replacing the salicylic acid derivative with 3-hydroxy-2-naphthoic acid (TCI-B3229 from Tokyo Chemical Industry Co., Ltd. to prepare a coating liquid for undercoat layer A-4.

<Preparation of Coating Liquid for Undercoat Layer A-5>

The procedure for preparation of the coating liquid for undercoat layer A-1 was repeated except for replacing the compound having the (I) with a compound having the following formula (II) to prepare a coating liquid for undercoat layer A-5.

(II)

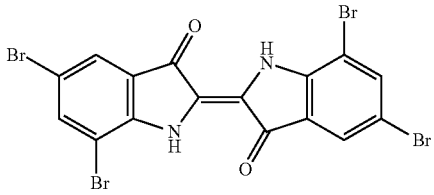

<Preparation of Coating Liquid for Undercoat Layer A-6>

The procedure for preparation of the coating liquid for undercoat layer A-1 was repeated except for replacing the compound having the (I) with a compound having the following formula (III) to prepare a coating liquid for undercoat layer A-6.

(III)

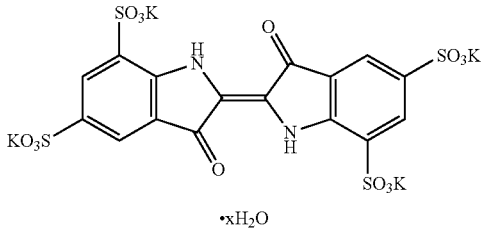

<Preparation of Coating Liquid for Undercoat Layer A-7>

The procedure for preparation of the coating liquid for undercoat layer A-1 was repeated except for replacing the binder resin with 10% by mass solution obtained by dissolving a polyurethane resin (Miractran 265 from Nippon Miractran Company Limited) in 2-butanone, and not adding the solvent to prepare a coating liquid for undercoat layer A-7.

<Preparation of Coating Liquid for Undercoat Layer A-8>

The procedure for preparation of the coating liquid for undercoat layer A-7 was repeated except for not adding the salicylic acid derivative to prepare a coating liquid for undercoat layer A-8.

<Preparation of Coating Liquid for Undercoat Layer A-9>

The procedure for preparation of the coating liquid for undercoat layer A-7 was repeated except for replacing the metal oxide particles with titanium oxide particles (PT-104M from Ishihara Sangyo Kaisha, Ltd.) to prepare a coating liquid for undercoat layer A-9.

<Preparation of Coating Liquid for Undercoat Layer A-10>

The procedure for preparation of the coating liquid for undercoat layer A-7 was repeated except for replacing the metal oxide particles with zirconium oxide particles (UEP from Daiichi Kigenso Kagaku Kogyo Co., Ltd.) to prepare a coating liquid for undercoat layer A-10.

<Preparation of Coating Liquid for Undercoat Layer A-11>

The procedure for preparation of the coating liquid for undercoat layer A-7 was repeated except for replacing the metal oxide particles with tin oxide particles (Nanoteka Sn $O_2$ from C. I. Kasei Co., Ltd.) to prepare a coating liquid for undercoat layer A-11.

<Preparation of Coating Liquid for Undercoat Layer A-12>

The procedure for preparation of the coating liquid for undercoat layer A-1 was repeated except for not adding the compound having the (I) prepare a coating liquid for undercoat layer A-12.

<Preparation of Coating Liquid for Undercoat Layer A-13>

The procedure for preparation of the coating liquid for undercoat layer A-1 was repeated except for replacing the binder resin with the following materials to prepare a coating liquid for undercoat layer A-13.

| Binder resin: | |
|---|---|
| Alkyd Resin (BECKOLITE M6401-50 from DIC Corp.) | 12 |
| Melamine resin solution (SUPER BECKAMIN G-821-60 from DIC Corp.) | 8 |

<Preparation of Coating Liquid for Undercoat Layer A-14>

The procedure for preparation of the coating liquid for undercoat layer A-13 was repeated except for not adding the compound having the (I) prepare a coating liquid for undercoat layer A-14.

Ingredients in each of the coating liquids for undercoat layer A-1 to A-14 are shown in Table 1.

TABLE 1

| Undercoat layer coating liquid | Metal oxide particles | Resin | Compound | Salicylic acid derivative |
|---|---|---|---|---|
| A-1 | Zinc oxide | BL-3175 + BM-1 | (I) | 3,5-di-t-butyl salicylic acid |
| A-2 | Zinc oxide | BL-3175 + BM-1 | (I) | 3-amino salicylic acid |
| A-3 | Zinc oxide | BL-3175 + BM-1 | (I) | 3,5-dinitro salicylic acid |
| A-4 | Zinc oxide | BL-3175 + BM-1 | (I) | 3-hydroxy-2-naphthoic acid |
| A-5 | Zinc oxide | BL-3175 + BM-1 | (II) | 3,5-di-t-butyl salicylic acid |
| A-6 | Zinc oxide | BL-3175 + BM-1 | (III) | 3,5-di-t-butyl salicylic acid |
| A-7 | Zinc oxide | Miractran 265 | (I) | 3,5-di-t-butyl salicylic acid |
| A-8 | Zinc oxide | Miractran 265 | (I) | — |
| A-9 | Titanium oxide | Miractran 265 | (I) | 3,5-di-t-butyl salicylic acid |
| A-10 | Zirconium oxide | Miractran 265 | (I) | 3,5-di-t-butyl salicylic acid |
| A-11 | Tin oxide | Miractran 265 | (I) | 3,5-di-t-butyl salicylic acid |
| A-12 | Zinc oxide | BL-3175 + BM-1 | — | 3,5-di-t-butyl salicylic acid |
| A-13 | Zinc oxide | Alkyd resin + Melamine resin | (I) | 3,5-di-t-butyl salicylic acid |
| A-14 | Zinc oxide | Alkyd resin + Melamine resin | — | 3,5-di-t-butyl salicylic acid |

[Preparation of Coating Liquid for Charge Generation Layer B]

<Preparation of Coating Liquid for Charge Generation Layer B-1>

A coating liquid for charge generation layer B-1 was prepared in the following manner.

The following materials were mixed together and were stirred using glass beads having a diameter of 1 mm and a bead-mill for 8 hours to prepare coating liquid for charge generation layer B-1.

| | |
|---|---|
| Charge generation material: titanyl phthalocyanine | 8 |
| Binder resin: polyvinyl butyral (S-LEC BX-1, available from SEKISUI CHEMICAL CO., LTD.) | 5 |
| Solvent: 2-butanone | 400 |

Figure 7:
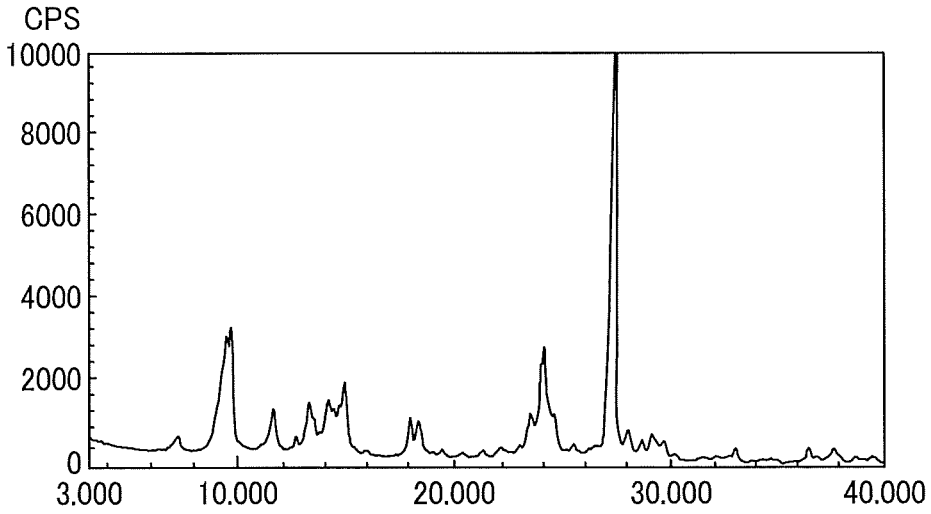
FIG. 7 is a graph of an X-ray diffraction spectrum of titanyl phthalocyanine used as a charge generating material in Examples.

FIG. 7 is a powder X-ray diffraction spectrum of the titanyl phthalocyanine.

<Preparation of Coating Liquid for Charge Generation Layer B2>

A coating liquid for charge generation layer B2 was prepared in the following manner.

The following materials were mixed together and were stirred until they were all dissolved to prepare a solution.

| | |
|---|---|
| Binder resin: polyvinyl butyral (S-LEC HLS, available from SEKISUI CHEMICAL CO., LTD.) | 4 |
| Solvent: cyclohexanone | 150 |

The following materials were added to the solution and dispersed by a ball mill for 48 hrs.

Charge generation material having the following formula.

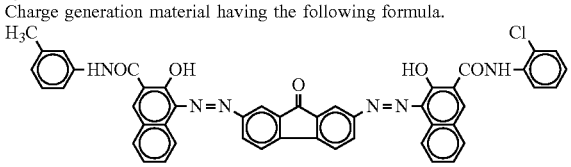

Next, 210 parts of cyclohexanone were added and dispersed for 3 hrs to prepare a dispersion.

The dispersion was placed in a container and diluted with cyclohexanone to have a solid content of 1.5% by mass to prepare a coating liquid for charge generation layer B2.

[Preparation of Coating Liquid for Charge Transport Layer C]

A coating liquid for charge transport layer C was prepared in the following manner.

The following materials were mixed together and were stirred until they were all dissolved to prepare a coating liquid for charge transport layer C.

| | |
|---|---|
| Charge transport material having the following formula | 7 |

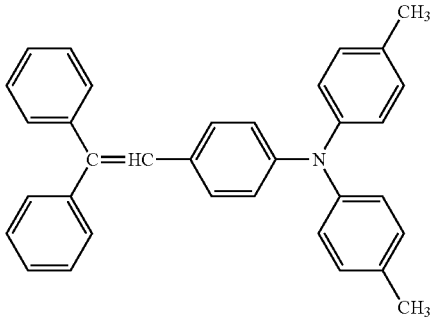

| | |
|---|---|
| Binder resin: polycarbonate (TS-2050, available from Teijin Chemicals Ltd.) | 10 |
| Leveling agent: silicone oil (KF-50, available from Shin-Etsu Chemical Co., Ltd.) | 0.0005 |
| Solvent: tetrahydrofuran | 100 |

Example 1

An aluminum cylinder (diameter: 100 mm, length: 380 mm) was coated with the coating liquid for undercoat layer A-1 by the dip coating method, and was dried at 170° C. for 30 min to form an undercoat layer having an average thickness of 7 μm. Next, the coating liquid for charge generation layer B-1 was coated on the undercoat layer by the dip coating method, and was dried at 90° C. for 30 min to form a charge generation layer having an average thickness of 0.2 μm. Furthermore, the coating liquid for charge transport layer C was coated on the charge generation layer by the dip coating method, and was dried at 150° C. for 30 min to form a charge transport layer having an average thickness of 25 μm. As described above, photoconductor 1 of Example 1 was prepared.

Examples 2 to 28 and Comparative Examples 1 to 6

The procedure for preparation of the photoconductor 1 in Example 1 was repeated except for changing the coating liquid for undercoat layer A, the coating liquid for charge generation layer B and the thickness of the undercoat layer as shown in Table 2 to prepare photoconductors 2 to 28 of Examples 2 to 28 and photoconductors 29 to 34 of Comparative Examples 1 to 6.

<Measurement of Thickness of Undercoat Layer>

A film thickness of the undercoat layer was measured by an eddy-current coating thickness tester (FISCHER SCOPE MMS, available from Fischer). An average thickness of the undercoat layer was determined by calculating the average value of thicknesses randomly-selected five points.

TABLE 2

| | Photoconductor | Undercoat Layer Coating liquid A | Charge Generation Layer Coating Liquid B | Average Thickness of Undercoat Layer (μm) |
|---|---|---|---|---|
| Example 1 | 1 | A-1 | B-1 | 30 |
| Example 2 | 2 | A-1 | B-1 | 25 |
| Example 3 | 3 | A-2 | B-1 | 20 |
| Example 4 | 4 | A-3 | B-1 | 20 |
| Example 5 | 5 | A-4 | B-1 | 20 |

TABLE 2-continued

| | Photoconductor | Undercoat Layer Coating liquid A | Charge Generation Layer Coating Liquid B | Average Thickness of Undercoat Layer (μm) |
|---|---|---|---|---|
| Example 6 | 6 | A-1 | B-1 | 15 |
| Example 7 | 7 | A-1 | B-1 | 10 |
| Example 8 | 8 | A-5 | B-1 | 7 |
| Example 9 | 9 | A-6 | B-1 | 5 |
| Example 10 | 10 | A-7 | B-1 | 5 |
| Example 11 | 11 | A-8 | B-1 | 5 |
| Example 12 | 12 | A-9 | B-1 | 3 |
| Example 13 | 13 | A-10 | B-1 | 3 |
| Example 14 | 14 | A-11 | B-1 | 35 |
| Example 15 | 15 | A-1 | B-2 | 30 |
| Example 16 | 16 | A-1 | B-2 | 25 |
| Example 17 | 17 | A-2 | B-2 | 20 |
| Example 18 | 18 | A-3 | B-2 | 20 |
| Example 19 | 19 | A-4 | B-2 | 20 |
| Example 20 | 20 | A-1 | B-2 | 15 |
| Example 21 | 21 | A-1 | B-2 | 10 |
| Example 22 | 22 | A-5 | B-2 | 7 |
| Example 23 | 23 | A-6 | B-2 | 5 |
| Example 24 | 24 | A-7 | B-2 | 5 |
| Example 25 | 25 | A-8 | B-2 | 5 |
| Example 26 | 26 | A-9 | B-2 | 3 |
| Example 27 | 27 | A-10 | B-2 | 3 |
| Example 28 | 28 | A-11 | B-2 | 35 |
| Comparative Example 1 | 29 | A-12 | B-1 | 20 |
| Comparative Example 2 | 30 | A-13 | B-1 | 20 |
| Comparative Example 3 | 31 | A-14 | B-1 | 20 |
| Comparative Example 4 | 32 | A-12 | B-2 | 20 |
| Comparative Example 5 | 33 | A-13 | B-2 | 20 |
| Comparative Example 6 | 34 | A-14 | B-2 | 20 |

<Properties of Photoconductor>

The photoconductors obtained in Examples and Comparative Examples were evaluated for electrical properties (residual potential) and image quality (background fouling, uneven image density and moire).

<<Evaluation Apparatus>>

A digital copying machine RICOH PROC900 from Ricoh Company, Ltd. that had been modified was used for Examples 1 to 14 and Comparative Examples 1 to 3. A digital copying machine imagio MP C5001 from Ricoh Company, Ltd. that had been modified was used for Examples 15 to 28 and Comparative Examples 4 to 6.

<<Method of Deteriorating Photoconductor>>

A test chart of black (image area ratio: 5%) was continuously produced on 50,000 sheets under an environment of 23° C. and 55% RH.

<<Evaluation of Electrical Properties (Residual Potential)>>

A surface potential of a photoconductor was measured before and after deterioration of the photoconductor. A developing unit of an evaluation device was modified and was attached with a potential sensor. The thus-obtained unit was mounted on the evaluation device to measure a potential as described below.

<Evaluation of Electrical Properties in Ricoh ProC900>

A voltage applied to a wire was −1,800 μA, and a grid voltage was −800 V. A full solid image was printed on 100 sheets of paper (size: A3) in the longitudinal direction, and then the first sheet of paper and the 100th sheet of paper were each measured for a potential (VL) of an irradiated part. A surface electrometer (MODEL 344 surface electrometer, available from TREK JAPAN) was used for measurement. An oscilloscope was used to record values obtained by the surface electrometer at 100 signals or more/second to evaluate electric properties based on the following criteria.

<Evaluation of Electrical Properties in Imagio MP C5001>

A charge DC voltage was −800 V, and a charge AC voltage was 2.1 KV. A full solid image was printed on 100 sheets of paper (size: A3) in the longitudinal direction, and then the first sheet of paper and the 100th sheet of paper were each measured for a potential (VL) of an irradiated part. A surface electrometer (MODEL 344 surface electrometer, available from TREK JAPAN) was used for measurement. An oscilloscope was used to record values obtained by the surface electrometer at 100 signals or more/second to evaluate electric properties based on the following criteria.

The evaluation was made under an environment of 23° C. and 55% RH.

Excellent: A potential difference (ΔVL) between a potential of an irradiated part of the first sheet of paper and a potential of an irradiated part of the 100th sheet of paper before and after the photoconductor deteriorated was less than 10 V.

Good: A potential difference (ΔVL) between a potential of an irradiated part of the first sheet of paper and a potential of an irradiated part of the 100th sheet of paper before and after the photoconductor deteriorated was 10 V or more but less than 30 V.

Poor: A potential difference (ΔVL) between a potential of an irradiated part of the first sheet of paper and a potential of an irradiated part of the 100th sheet of paper before and after the photoconductor deteriorated was 30 V or more.

[Image Evaluation]

An image was produced before and after the photoconductor deteriorated under an environment of 23° C. and 55% RH, followed by evaluation of background fouling, uneven image density and moire.

A white background image was continuously produced on 5 sheets of gloss coat paper to count the number of background fouling visually observable at random ten visual fields of 8 mm×11 mm and average the number.

The evaluation was made under an environment of 23° C. and 55% RH.

Excellent: 10 or less

Good: more than 10 and 20 or less

Poor: more than 20

A half-tone image was continuously produced on 100 sheets to visually observe uneven image density of the first and 100th sheets.

Excellent: No uneven image density was observed

Good: Negligible level of uneven image density for practical use was observed

Poor: Uneven image density was apparently observed

A half-tone image was continuously produced on 100 sheets to visually observe moire of the first and 100th sheets.

Excellent: No moire was observed

Good: Negligible level of moire for practical use was observed

Poor: Moire was apparently observed

The evaluation results are shown in Table 3.

TABLE 3

| | Residual Potential | | Background Fouling | | Image Density | | Moire | |
|---|---|---|---|---|---|---|---|---|
| | Before | After | Before | After | Before | After | Before | After |
| Example 1 | Excellent | Good | Excellent | Excellent | Excellent | Excellent | Excellent | Excellent |
| Example 2 | Excellent | Good | Excellent | Excellent | Excellent | Excellent | Excellent | Excellent |
| Example 3 | Excellent | Excellent | Excellent | Good | Excellent | Excellent | Excellent | Excellent |
| Example 4 | Excellent | Good | Excellent | Excellent | Excellent | Excellent | Excellent | Excellent |
| Example 5 | Excellent | Good | Excellent | Excellent | Excellent | Excellent | Excellent | Excellent |
| Example 6 | Excellent | Excellent | Excellent | Excellent | Excellent | Excellent | Excellent | Excellent |
| Example 7 | Excellent | Excellent | Excellent | Excellent | Excellent | Excellent | Excellent | Excellent |
| Example 8 | Excellent | Good | Excellent | Excellent | Excellent | Excellent | Excellent | Excellent |
| Example 9 | Excellent | Good | Excellent | Good | Excellent | Excellent | Excellent | Excellent |
| Example 10 | Excellent | Excellent | Excellent | Good | Excellent | Good | Excellent | Excellent |
| Example 11 | Excellent | Good | Good | Good | Excellent | Good | Excellent | Excellent |
| Example 12 | Excellent | Good | Excellent | Good | Excellent | Good | Excellent | Excellent |
| Example 13 | Good | Good | Excellent | Good | Excellent | Good | Excellent | Excellent |
| Example 14 | Excellent | Good | Excellent | Good | Excellent | Good | Excellent | Excellent |
| Example 15 | Excellent | Excellent | Excellent | Excellent | Excellent | Good | Excellent | Excellent |
| Example 16 | Excellent | Excellent | Excellent | Excellent | Excellent | Good | Excellent | Excellent |
| Example 17 | Excellent | Excellent | Excellent | Good | Excellent | Excellent | Excellent | Excellent |
| Example 18 | Excellent | Good | Excellent | Excellent | Excellent | Excellent | Excellent | Excellent |
| Example 19 | Excellent | Good | Excellent | Excellent | Excellent | Excellent | Excellent | Excellent |
| Example 20 | Excellent | Excellent | Excellent | Excellent | Excellent | Excellent | Excellent | Excellent |
| Example 21 | Excellent | Excellent | Excellent | Excellent | Excellent | Excellent | Excellent | Excellent |
| Example 22 | Excellent | Good | Excellent | Excellent | Excellent | Excellent | Excellent | Excellent |
| Example 23 | Excellent | Good | Excellent | Good | Excellent | Excellent | Excellent | Good |
| Example 24 | Excellent | Excellent | Excellent | Good | Excellent | Good | Excellent | Good |
| Example 25 | Excellent | Good | Good | Good | Excellent | Good | Excellent | Good |
| Example 26 | Excellent | Excellent | Good | Good | Excellent | Good | Excellent | Good |
| Example 27 | Excellent | Good | Excellent | Good | Excellent | Good | Excellent | Excellent |
| Example 28 | Excellent | Excellent | Good | Good | Excellent | Good | Excellent | Excellent |
| Comparative Example 1 | Excellent | Excellent | Good | Poor | Excellent | Good | Excellent | Excellent |
| Comparative Example 2 | Excellent | Good | Good | Poor | Excellent | Good | Excellent | Excellent |
| Comparative Example 3 | Excellent | Poor | Poor | Poor | Good | Poor | Excellent | Good |
| Comparative Example 4 | Excellent | Excellent | Good | Poor | Good | Poor | Poor | Poor |
| Comparative Example 5 | Excellent | Good | Good | Poor | Excellent | Good | Excellent | Excellent |

TABLE 3-continued

| | Residual Potential | | Background Fouling | | Image Density | | Moire | |
|---|---|---|---|---|---|---|---|---|
| | Before | After | Before | After | Before | After | Before | After |
| Comparative Example 6 | Excellent | Good | Poor | Poor | Good | Poor | Poor | Poor |

Having now fully described the invention, it will be apparent to one of ordinary skill in the art that many changes and modifications can be made thereto without departing from the spirit and scope of the invention as set forth therein.

What is claimed is:

1. A photoconductor, comprising:

an electroconductive substrate;

an undercoat layer overlying the electroconductive substrate; and a photosensitive layer overlying the undercoat layer, wherein the undercoat layer includes a urethane resin, a metal oxide particle and a compound having the following formula (1):

(1)

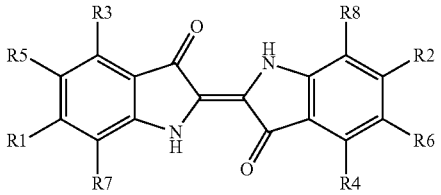

wherein each of R1 to R8 independently represents a hydrogen atom, a nitro group, a cyano group, a halogen atom, a hydroxyl group, a saturated or an unsaturated aliphatic hydrocarbon group which may have a substituent, an aromatic hydrocarbon group which may have a substituent, an alkoxy group which may have a substituent, an aryloxy group which may have a substituent, a sulfo group which may have a substituent, an amino group, a dialkylamino group which may have a substituent or an diarylamino group which may have a substituent; and R3 and R4, R4 and R5, R6 and R7, and R7 and R8 may be bonded with each other to form an aromatic ring.

2. The photoconductor of claim 1, wherein the metal oxide particle is a zinc oxide particle.

3. The photoconductor of claim 1, wherein the undercoat layer further includes a salicylic acid derivative.

4. The photoconductor of claim 1, wherein the urethane resin is a curable resin.

5. The photoconductor of claim 1, wherein the undercoat layer has an average thickness of from 7 μm to 30 μm.

6. The photoconductor of claim 1, wherein the photosensitive layer comprises an azo pigment as a charge generation material.

7. An image forming apparatus, comprising:

the photoconductor according to claim 1;

a charger to charge the surface of the photoconductor;

an irradiator to irradiate the surface of the photoconductor to form an electrostatic latent image;

an image developer to develop the electrostatic latent image with a toner to form a visible image; and a transferer to transfer the visible image onto a recording medium.

8. A process cartridge, comprising:

the photoconductor according to claim 1; and at least a member selected from a group consisting of:

a charger to charge the surface of the photoconductor;

an irradiator to irradiate the surface of the photoconductor to form an electrostatic latent image;

an image developer to develop the electrostatic latent image with a toner to form a visible image; and a transferer to transfer the visible image onto a recording medium.

* * * * *